United States Patent [19]

Mälkiä

[11] Patent Number: 4,738,197

[45] Date of Patent: Apr. 19, 1988

[54] COOLING OF A PAPER WEB IN A SUPERCALENDER

[75] Inventor: Hannu Mälkiä, Appleton, Wis.

[73] Assignee: Oy Wärtsilä Ab, Helsinki, Finland

[21] Appl. No.: 798,593

[22] Filed: Nov. 15, 1985

[30] Foreign Application Priority Data

Nov. 30, 1984 [FI] Finland ..... 844730

[51] Int. Cl.[4] ..... B30B 3/04; B30B 13/00; B30B 15/34

[52] U.S. Cl. ..... 100/38; 100/93 RP; 162/206

[58] Field of Search ..... 100/38, 35, 93 RP, 162 R, 100/162 B; 162/205, 206, 207; 427/362

[56] References Cited

U.S. PATENT DOCUMENTS 1,862,656 6/1932 Boyer ..... 162/206
3,352,232 11/1967 Leibelt ..... 162/206 X
3,451,331 6/1969 Fredrickson et al. ..... 100/93 RP
4,277,524 7/1981 Nakajima et al. ..... 427/362
4,370,923 2/1983 Schmidt ..... 100/93 RP

*Primary Examiner*—Peter Feldman
*Attorney, Agent, or Firm*—Dellett, Smith-Hill & Bedell

[57] ABSTRACT

The invention relates to a method for accomplishing smoothness and glaze to paper or board webs in a calender by leading a web through hot nips which are formed between cooperating rolls of different hardnesses and having adjustable temperatures, and where a gradient calendering of the web based on the temperature difference between the web and the rolls is brought about. In order to increase the efficiency of the gradient calendering and in order to achieve a suitable temperature difference between the web and the heated rolls, the temperature of the web is arranged to be adjustable before the web enters the hot nip.

13 Claims, 5 Drawing Sheets

COOLING OF A PAPER WEB IN A SUPERCALENDER

Figure 1:
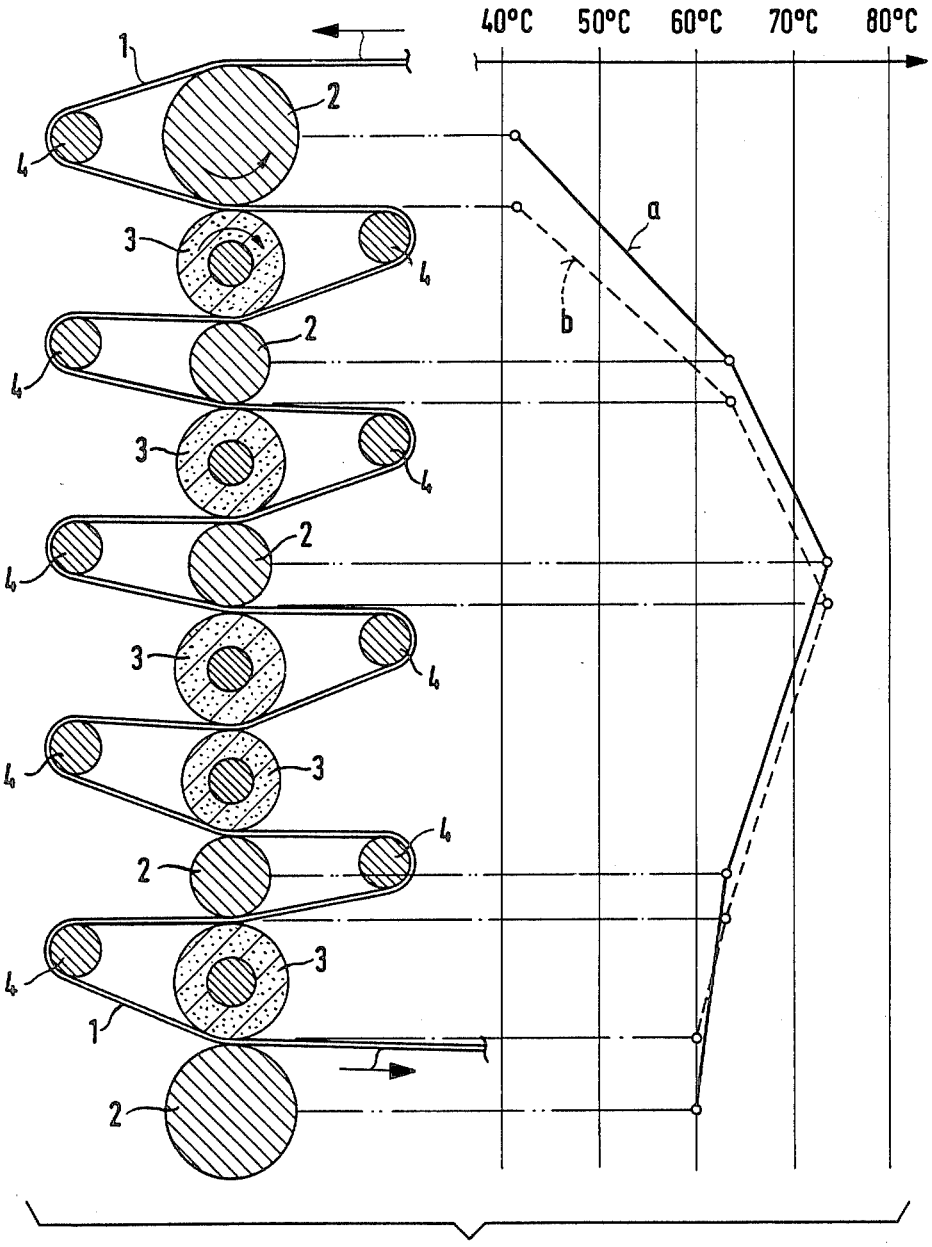

The invention relates to a method for calendering of a paper web according to the preamble of claim 1, as well as to an arrangement for applying the method.

The surface of a board or paper web produced by means of a paper machine is always somewhat uneven and rough after drying. There are, however, requirements on a paper of high quality such as good glaze and smoothness and uniform thickness. These characteristics are accomplished by means of a treatment, so-called calendering, which takes place after the drying process. As is well known, there are two main types of calenders: stacks which consist of a number of hard rolls journalled in bearings and forming hard nips through which the web to be treated is passing, and supercalenders, in which some of the rolls are soft and covered, for example, by fibrous material or rubber. Calenders yield the smoothness of a paper practically only by compressing the paper perpendicularly in direction to the plane of the paper. The glaze is produced by the speed difference occurring between the web and the surface of the rolls, which difference accompanying slipping and friction accomplishes desired glazing. In addition to the accomplishment of glaze and smoothness, the important functions of calendering includes such as to give the web a definite thickness (calibre), to smooth out possible differences in thickness, to make the paper better printing base, etc.

The calender treatment is necessary above all to writing and printing papers. For ordinary writing papers and such papers which mainly are printed with text, the machine finishing of a stack usually will be sufficient. If the presswork, on the contrary, comprises printing with several different colours, better smoothness and glaze are required of the surface of the paper, in which case a treatment performed by means of a supercalender is necessary. Stacks are often arranged directly in connection with a paper machine by means of a so called on-machine-arrangement. Fiber rolls of a supercalender are easily damaged especially at high driving speeds, for which reason there usually are two separate supercalenders subsequent to a paper machine as so-called off-machine devices. There has also been developed on-machine supercalenders which have not yet, however, gained a foothold because of their poor capability to produce so called super glaze.

The effect of calendering upon a web depends on several factors, some of the most important of which are:

the linear pressure at the nip,
the temperature of the rolls,
the temperature of the web,
the number of nips,
the moisture content of the web,
the speed of the machine.

The temperature of a paper web increases during a calendering process due to heated rolls or to the friction appearing in the nips, which is likely to favour an easy calendering of the paper, in other words, with a certain linear pressure there is gained a greater glaze and a reduced roughness and oil absorption at a higher temperature. In a conventional supercalender the paper gets progressively warmer until approximately the middle of the roll stack, where the temperature of the paper is about 70°-80° C. and the temperature of the rolls is about 70° C. A disadvantage of the increase in temperature is the increase of paper density caused by this, and a significant reduction of the light-scattering coefficient. The increase of density reduces the plasticity of the paper, and the reduction of the light-scattering coefficient, i.e. the transparency of a paper, is of inconvenience especially in two-sided printing.

When a cold paper web is led through a hot nip in a calender, this causes a warming up of the paper web in the nip on both its outer surfaces. The contact time in the nip is, however, too short for the middle layer of the paper to get warm. The result is so-called temperature-gradient calendering, in other words the surface layers of the paper are in such a nip calendered more strongly in the compression of the nip than the colder middle layer. This appears in finished paper, so that on a certain level of smoothness or glaze, the density of the paper remains lower than in the case of a uniform temperature profile. A temperature-gradient calendering method of this kind is presented, for example, in the publication Tappi Journal, October 1982, pages 97-101.

A disadvantage of the temperature-gradient calendering method known in the art is the warming up of the web in the direction of the thickness to too high a degree when several heated rolls are used in sequence. For this reason the temperature of the rolls must be very high to obtain sufficiently great a difference in temperature between the web and the rolls. This, however, results in a partial loss of the advantages of the calendering according to the method, because the difference between the calendering grades of the surface and middle layers of the paper web is difficult to control at a high temperature.

Due to the high temperature required, another disadvantage of the known method is the poor suitability of the method for supercalendering. The soft rolls coated by fibrous material in a supercalender are very likely to suffer damage and abnormally severe wear when temperature rises, for which reason the surface temperature of conventional soft rolls should not exceed 90°-100° C.

The object of the invention is to avoid the disadvantages of the known temperature-gradient calendering method and to increase the efficiency of gradient calendering. The object is further to create an uncomplicated arrangement, by means of which a suitable temperature difference between the web and the surface of the rolls is achieved. The invention is based on the insight, that temperature-gradient calendering can be made more effective and be applied for supercalendering, by using the temperature of the paper web as an independent control variable for calendering. Hereby the temperature difference between the web and the roll implied by gradient calendering is reached under prevalence of considerably lower temperatures, which is likely to improve the effect and quality of the calendering. According to the method it is also possible to place in a stack of rolls several heated rolls consecutively. In comparision with a paper produced by conventional methods it is thus possible by means of the calendering method according to the invention to gain, among other advantages, the following:

the density of the paper remains lower, and varies in the direction of the thickness, so that the density of the surface layer is considerably higher than the density of the middle layer,
a greater smoothness of the surface is gained,
a better glaze is accomplished, i.e. the smoothness on microlevel, too, is better, the result is less light-scattering, better printing qualities are gained because of the reduced absorption of printing ink, and in addition, also the strength values of the paper on a certain density level will be improved.

The characteristic features of the invention are disclosed in claim 1. By means of arranging the temperature of the web to be adjustable before the web enters a hot nip, it is possible to increase the efficiency of gradient calendering and to achieve a suitable temperature difference between the web and the heated rolls at a suitable level. This means that the paper web, in a manner known as such, is cooled before the web gets into a nip formed by rolls equipped with a tempering device, so that the temperature difference between the surface and middle layers of the paper can freely be chosen in separate nips, because both the web temperature and the surface temperatures of the rolls can be controlled separately. The cooling of the web takes place either by means of cooled take out, pivot or guide rolls belonging to the supercalender, or by using separate cooling rolls or cylinders. The cooling can also be carried out by directing a cold gas or liquid jet to the web. If the cooling is accomplished by means of a liquid jet, there is an additional advantage in the form of possibility to use the same device for gradient calendering based on differences between moisture contents of different layers of thickness of the paper web. Hereby the liquid jet must be directed to the web so, that the liquid has time to be absorbed only into the surface layer of the paper before the web gets into the nip.

The position of cooling rolls and other corresponding cooling devices must be arranged so that the distance between the cooling device and the nip is great enough to equalize the temperature profile through the thickness of a paper web before the nip. Thus both the web speed and the magnitude of cooling have an effect on the suitable distance.

Figure 2:
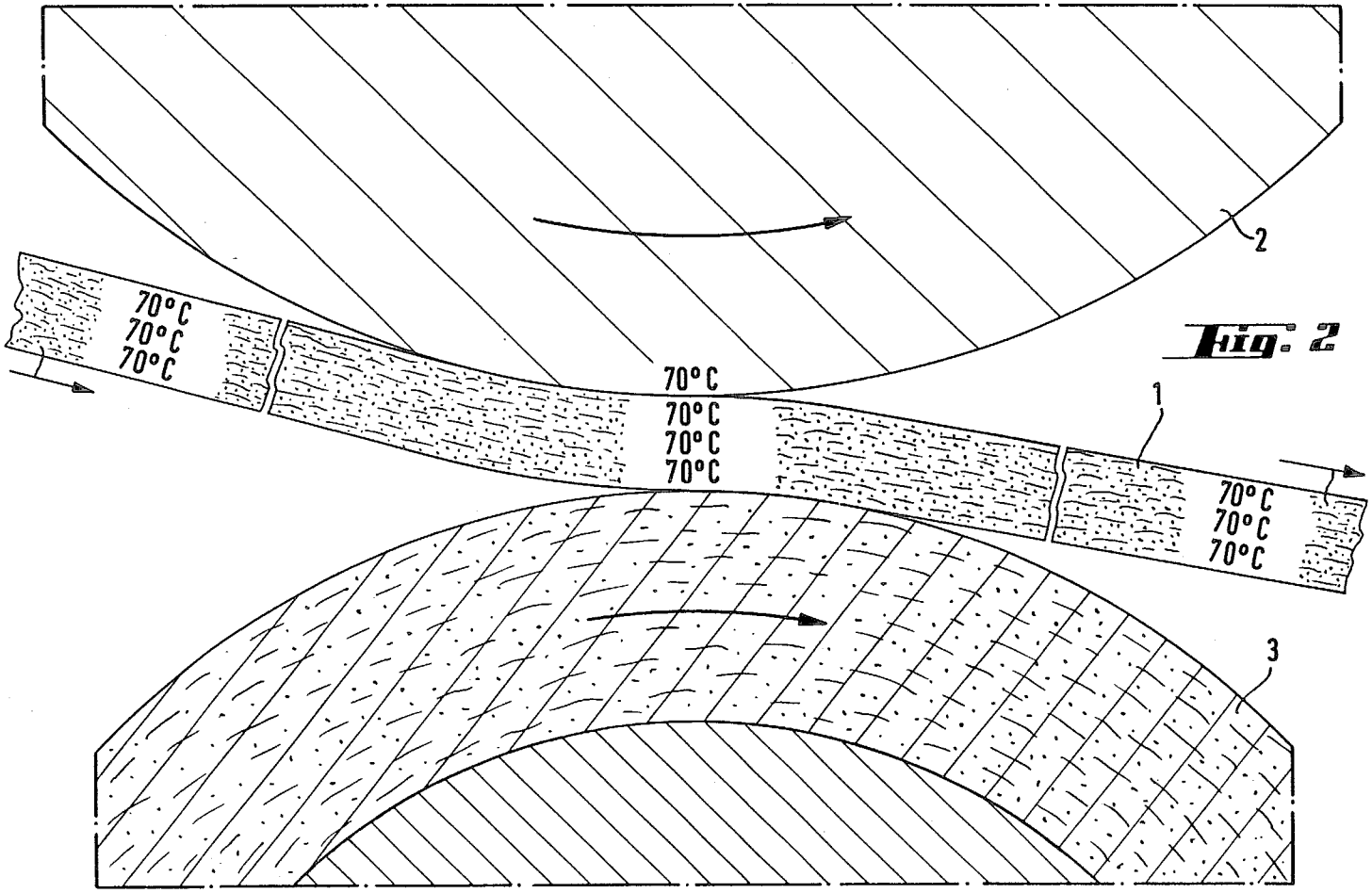
Figure 5:
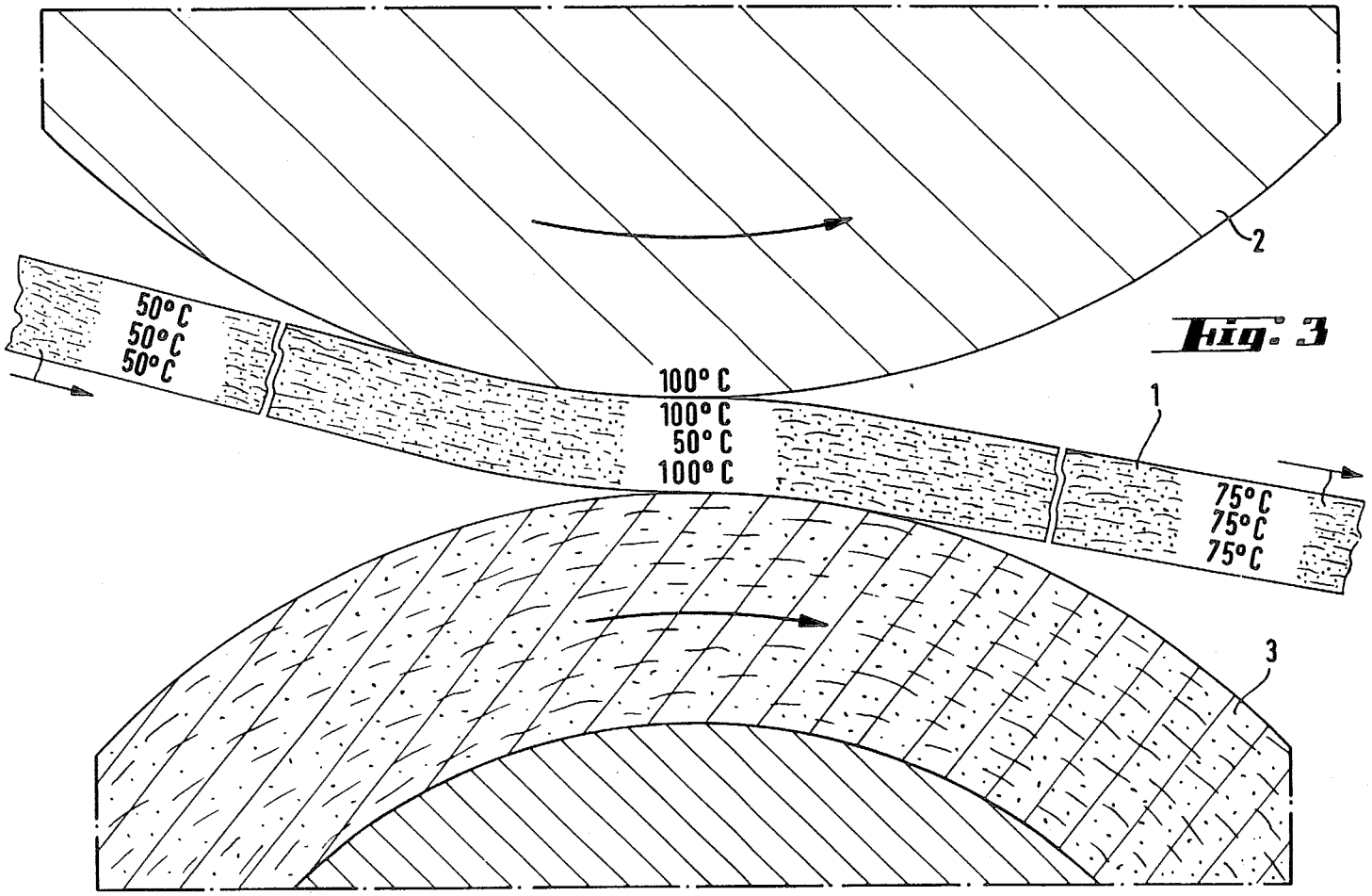
Figure 4:
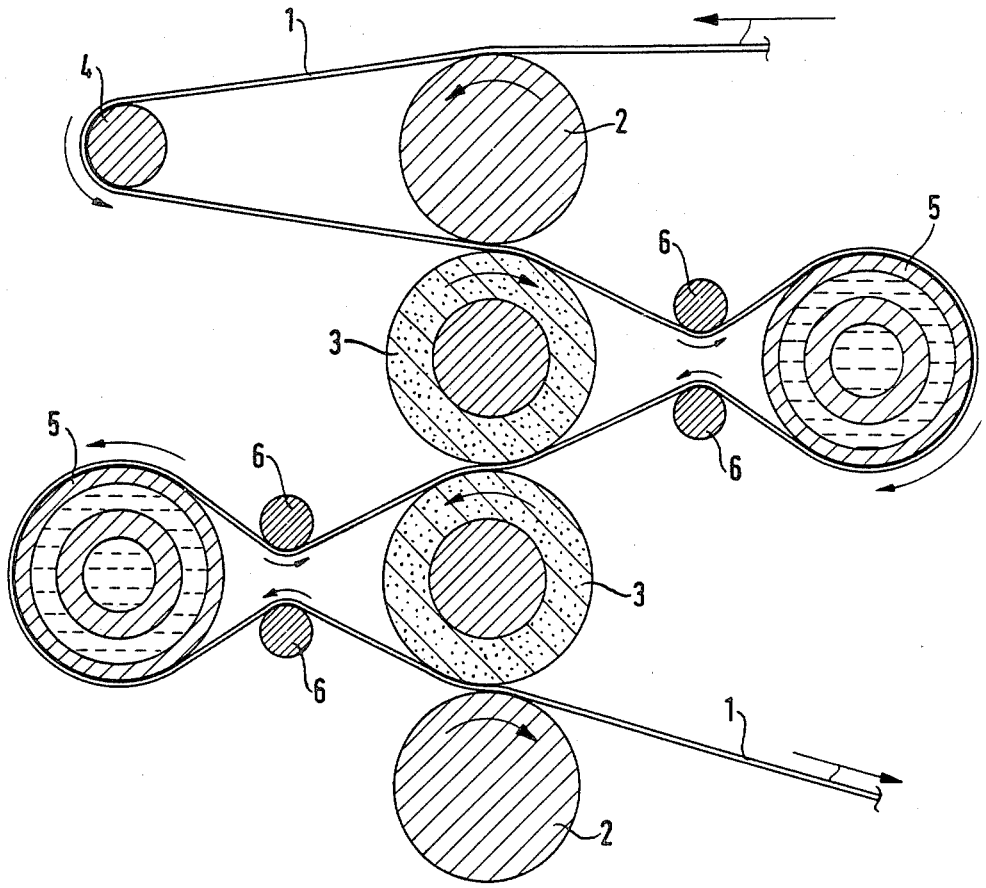
Figure 5:
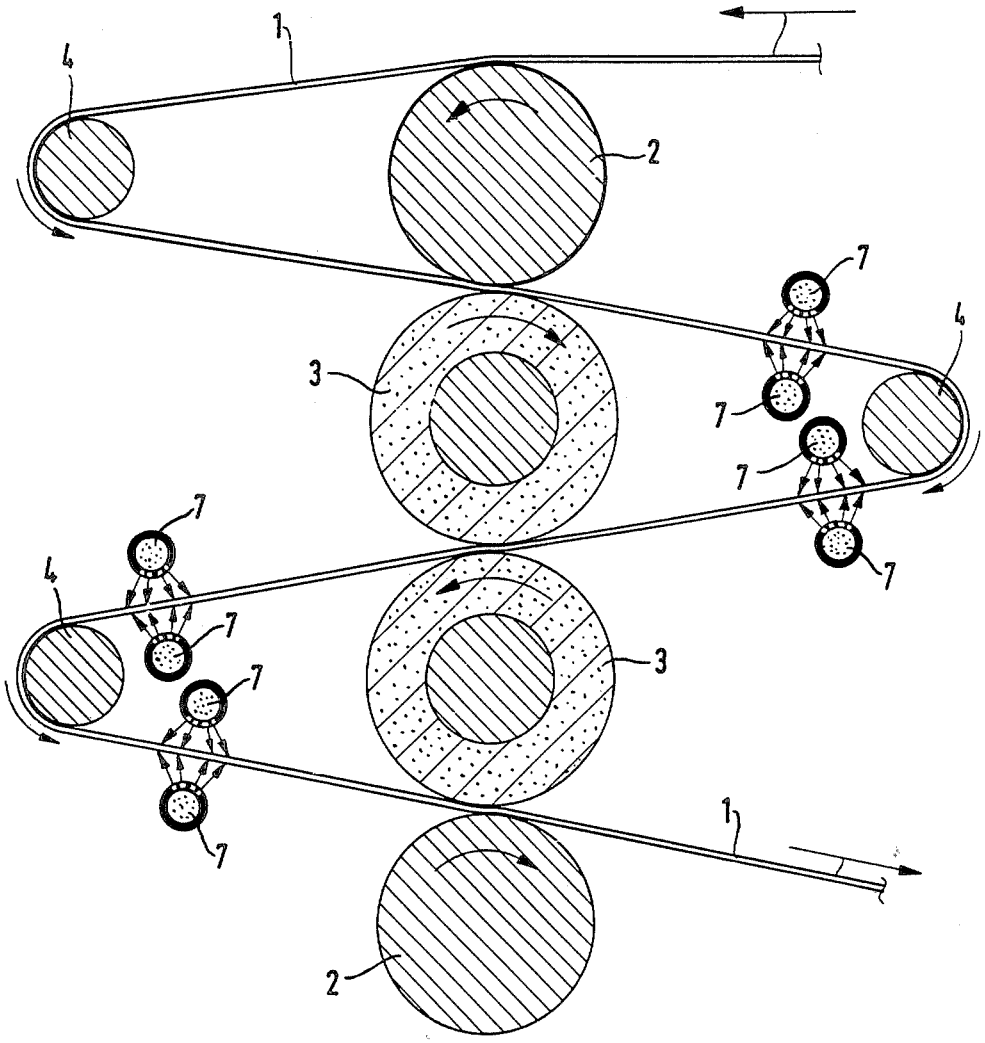

The invention will in the following be described with reference to the accompanying drawing, in which FIG. 1 is a side view of a conventional supercalender and, in this, a temperature profile measured in the longitudinal direction of the stack and paper web, FIG. 2 shows a temperature profile in the direction of the thickness of a paper web in a calender according to FIG. 1, FIG. 3 shows a desired temperature profile in a calender according to the invention, FIG. 4 is an embodiment of the arrangement according to the invention, FIG. 5 is another embodiment of the arrangement according to the invention.

In a conventional supercalender set forth in FIG. 1, a paper or board web 1 is led into the roll stack of a supercalender formed by hard chill casting or steel rolls 2 and soft fibre or rubber rolls 3 which are placed one on top of another or in succession. The motion of the web 1 through the nips formed by the rolls is guided by take-out or guide rolls 4. Cold paper coming from a paper machine begins to get warm in a supercalender, until the warming up smooths down approximately in the middle of the roll stack. Hereby the quantity of heat being transferred to the paper web in the nips reaches a balance with the cooling which takes place between the nips and is caused among other things by evaporation. The line a of FIG. 1 shows the temperature profile of the rolls at different measure points, and the line b accordingly the temperature of the web. The temperature of the paper web is even in the direction of thickness of the web. In the Figure, showing a conventional supercalander, the rolls are not heated, but their temperature is mainly due to friction. Hereby the temperature profile in the direction of the thickness of the web corresponds the situation according to FIG. 2. When heated rolls and warm nips are used, the temperature of the web rises respectively.

In FIG. 3 there is presented the desired temperature profile through the thickness of a paper web in an embodiment of the invention.

By cooling a web so that its temperature when entering a nip is not higher than 70° C., preferably not higher than 50° C., a satisfactory gradient calendering can be gained already by using rolls having the temperature of 100° C. When leaving a nip, the temperature of a web smooths down to about 70°–80° C. If the web after that is led into another gradient nip, a cooling of the web preceeds this treatment.

The cooling can be carried out by equipping the take-out rolls 4 according to FIG. 1, with a known cooling device based on internal water circulation or some corresponding method. The cooling of a roll can also be carried out externally by directing to the roll a cold liquid jet or gas blasting.

The cooling capability can be improved by using separate cooling rolls 5 or cylinders of greater diameter, of a kind that is presented in FIG. 4. By arranging guide rolls 6 in connection with a cooling roll 5, the contact area between the web and the cooling roll can be extended in order to make the cooling more effective.

In FIG. 5 there is presented the construction of a cooling system based on air blasting or liquid jet. Vapour spraying pipes or gas blasting devices 7 accomplish here desired cooling.

The invention is not limited to the embodiment shown, but several modifications of the invention are feasible within the scope of the attached claims. A device according to the invention can, for example, be combined with a control device according to patent publication U.S. Pat. No. 4,370,923 in order to achieve an accurate control of the temperatures.

I claim:

1. A method for imparting smoothness and glaze to an uncoated web of paper or board in a calender by means of leading a web through hot nips which are formed between cooperating heated rolls of different hardnesses and having adjustable temperatures, in which calender a gradient calendering of the web is brought about, based on a temperature difference between the web and the heated rolls, so that, in order to increase the efficiency of the gradient calendering and in order to achieve a suitable temperature difference between the web and the heated rolls, the web is cooled before it enters the hot nip, the cooling being substantially uniform in the transverse direction of the web.

2. A method according to claim 1, where the web is cooled so, that its temperature when entering the nip is not higher than 70° C., favourably not higher than 50° C.

3. A method according to claim 1, where the temperature difference in the nip between the web and the rolls is at least 30° C., favourably at least 40° C.

4. A calender for treating a heated web which is delivered to the calender, comprising (a) means for cooling the heated web substantially uniformly in the transverse direction of the web, (b) at least two rolls which define a nip therebetween for receiving the cooled web, the rolls being of different respective hardnesses, and (c) means for heating each roll to a selectively adjustable temperature.

5. A calender according to claim 4, in which the cooling means consist of take-out or guide rolls belonging to the calender or of separate cooling rolls or cylinders, in which rolls or cylinders the cooling is carried out either by means of an internal cooling device based on water circulation or some corresponding system, or by means of external cooling based on gas blasting, liquid jet or the like.

6. A calender according to claim 4, in which the cooling of the web is carried out by directing a cold gas or liquid jet to the web.

7. A calender according to claim 6, in which the cooling means also can be used for gradient calandering based on a difference between the moisture contents of separate layers of the thickness of a web.

8. A method of calendering an uncoated web of paper or board, comprising cooling the web substantially uniformly in the transverse direction of the web without exposing it to substantial pressure, feeding the cooled web through a nip defined by external surfaces of cooperating heating rolls, and maintaining the external surface of each heating roll at a temperature that is higher than the temperature of the web prior to being cooled.

9. A method according to claim 8, wherein the web is cooled by directing a stream of liquid against the web.

10. A method according to claim 8, wherein the web is cooled by directing a stream of gas against the web.

11. A method according to claim 8, wherein the web is cooled by bringing one side of the web into contact with a member which is at a temperature that is lower than the temperature of the web prior to being cooled, the side of the web opposite said member being exposed to atmospheric pressure.

12. A method according to claim 8, comprising cooling the web to a temperature not higher than 70° C.

13. A method according to claim 8, comprising cooling the web to a temperature that is at least 30° C. below the temperature of the external surfaces of the cooperating rolls.

* * * * *